United States Patent [19]

Wood

[11] Patent Number: 4,997,196

[45] Date of Patent: Mar. 5, 1991

[54] ILLUMINATED SKATEBOARD

[76] Inventor: John L. Wood, 3327 Mill Springs Rd., Stocton, Calif. 95209

[21] Appl. No.: 429,089

[22] Filed: Oct. 30, 1989

[51] Int. Cl.[5] ..... B62M 1/00

[52] U.S. Cl. ..... 280/87.042; 362/61; 362/800

[58] Field of Search ..... 280/87.041, 87.042, 280/11.19, 11.27, 842, 841, 11.12, 816, 809; 362/103, 61, 78, 800

[56] References Cited

U.S. PATENT DOCUMENTS

| | | | |
|---|---|---|---|
| 2,505,154 | 4/1950 | Smith | 280/809 |
| 4,240,132 | 12/1980 | Wickman | 362/103 |
| 4,336,573 | 6/1982 | Carter | 362/78 |
| 4,367,515 | 6/1983 | Beard | 362/103 |
| 4,463,412 | 7/1984 | Broach | 362/103 |
| 4,648,610 | 3/1987 | Heggi | 280/11.19 |
| 4,837,494 | 6/1989 | Maier | 280/809 |

*Primary Examiner*—Andres Kashnikow
*Assistant Examiner*—Richard Camby
*Attorney, Agent, or Firm*—Ralph S. Branscomb

[57] ABSTRACT

Improvements to a skateboard comprise a board having a complete string of LED's embedded in a groove around the periphery of the skateboard in the first embodiment, powered by a microcontroller and a battery mounted to the underside of the board. In the second embodiment, along the same lines, a kit is provided wherein skid bars have the LED's mounted in them, connected by wiring leading to the microcontroller and battery. The kit can be sold for after-market use, and may consist of just the two side boards, or the rear skid board as well, often called the kick board.

4 Claims, 2 Drawing Sheets

ILLUMINATED SKATEBOARD

BACKGROUND OF THE INVENTION

Approximately twenty-five years ago, skateboards were invented and achieved a certain amount of popularity. They then passed, becoming something of a fad. Then, with the invention of Polyurethane wheels, skateboards attained a renewed popularity that has continued and shows no signs of letting up.

Many improvements have been provided to skateboards, as in any product. These improvements involve the visual appearance of the skateboards, which are quite prolific in nature, and improvements in their functionality and safety as well. Safety improvements include brakes, and functional improvements include improved turning ability of the trucks, different flexibilities of the boards for different applications and other engineering modifications.

Skateboarding, however, are perceived by the parents of the skateboarders as being a very dangerous endeavor. It is dangerous enough in the daytime when cars can hopefully see the skateboarders, but at night the problem is exacerbated. Skateboards with lights on them have been designed, such as one having a light mounted on one or both of the trucks; however, this lighting is somewhat limited in nature due to its physical scope.

There is a need, therefore, for a lighting system that is low in energy usage and which continues around the perimeter of the board to protect the boarder from all sides.

SUMMARY OF THE INVENTION

The improvements to the instant invention include two basic embodiments. In the first embodiment, a peripheral groove around the entirety of the skateboard is filled with a continuous string of LED's which are covered with resin or a hot-injected glue. A microcontroller which operates the LED's in any sequence desired by the designer of the microcontroller is mounted to the underside of the skateboard. The battery is mounted adjacent the microcontroller, and the microcontroller then through a series of wire connections, the number of wires obviously depending on the complexity of the sequence of operation of the LED's.

In a second embodiment, a similar concept is provided in a kit suitable to the retrofit market. This kit includes a pair of skid plates, each of which has embedded in it a string of LED's. The plate and the bars are provided with holes by which they can be screwed directly into the bottom of the skateboard, so that anyone already owning a skateboard can adapt it to the LED model.

DETAILED DESCRIPTION OF THE PREFERRED EMBODIMENT

Figure 1:
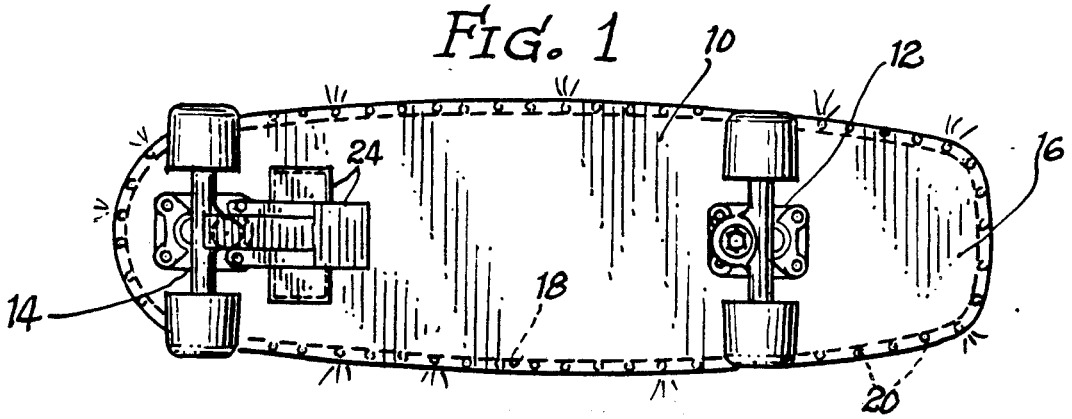
FIG. 1 is a bottom plan view of a skateboard.
Figure 2:
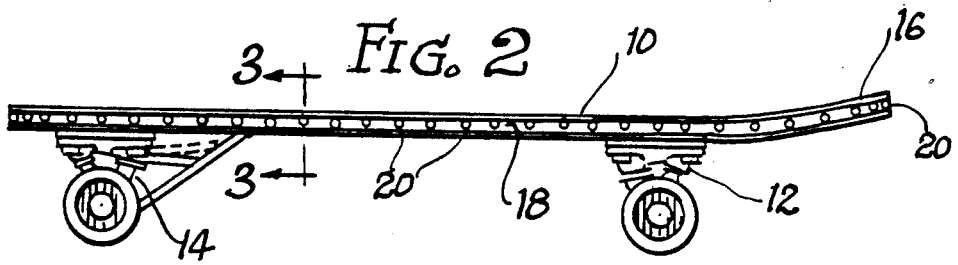
FIG. 2 is a side elevation view of FIG. 1.
Figure 3:
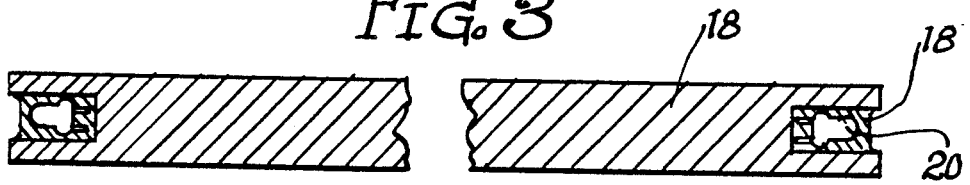
FIG. 3 is a partial section taken along line 3—3 of FIG. 2.

A typical skateboard is shown in FIG. 1, having the board portion 10, which could be plywood, or fiberglass, a front truck 12, consisting of a steerable central axis and a pair of wheels, and a rear truck 14, and a front, upturned prow 16. This is all there is to a conventional skateboard, except for the graphics, and perhaps a non-skid surface on top.

In the first embodiment of the invention, the board 10 is routed out or provided in laminates of different sizes so that groove 18 is provided around the entire periphery of the board. In this groove, there is a continuous string of LED's 20. The LED's are connected through wiring 22 to a microcontroller powered by a battery shown combined and diagrammatically at 24.

Figure 4:
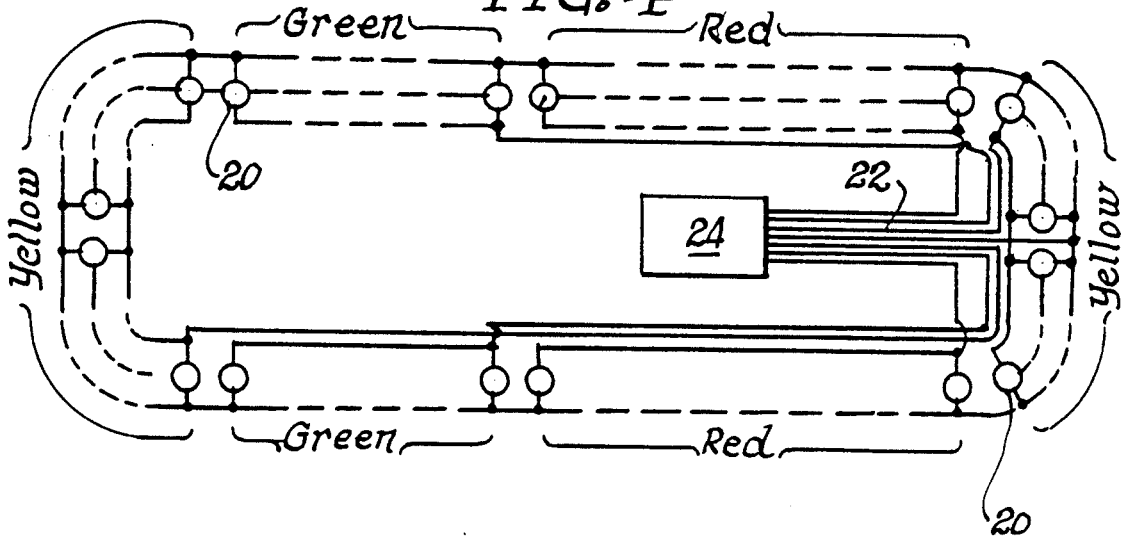
FIG. 4 is a diagram of the LEd coloring scheme.

Although any combination of light colors and sequencing of operation is possible, the inventor has illustrated one in FIG. 4 wherein the red, green and yellow lights are provided and are sequentially lit so that it appears that the lights are moving around the skateboard. However, obviously, any type of sequencing or light coloring could be used.

The second embodiment is provided for individuals who already own a skateboard and do not want to incur the expense of purchasing a new one such as shown in FIG. 1. For these people, a kit is provided having as its basis a pair of skid boards 26 which are provided with mounting screw holes 28, and these side boards are also grooved at 30 with each groove containing an LED string 32.

Although the kit could be limited to the two side boards, in the best embodiment, the tail piece 34 is also built along similar lines to the side boards. The rear bumper 36 is not part of the invention.

Figure 5:
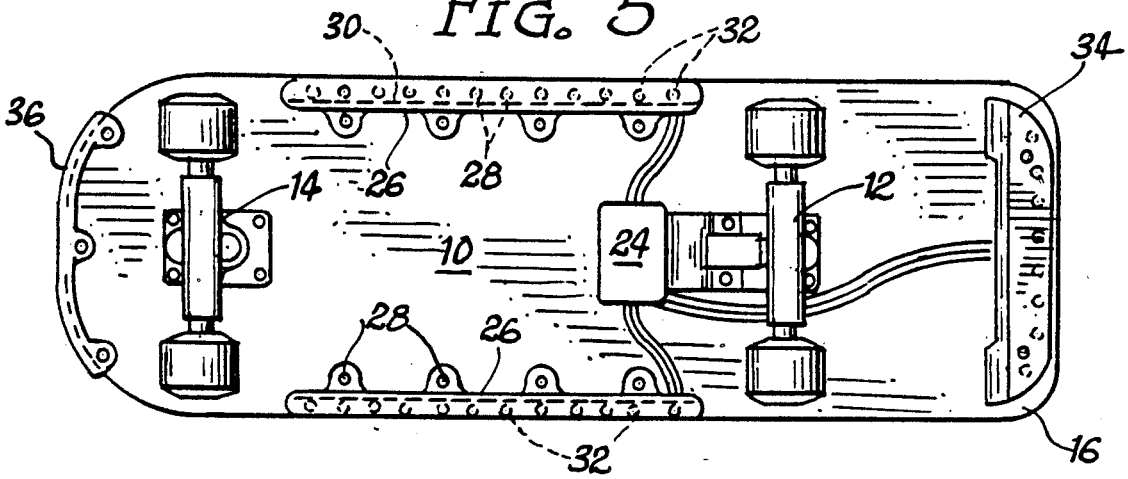
FIG. 5 is a bottom plan view of a modified form of the invention.
Figure 6:
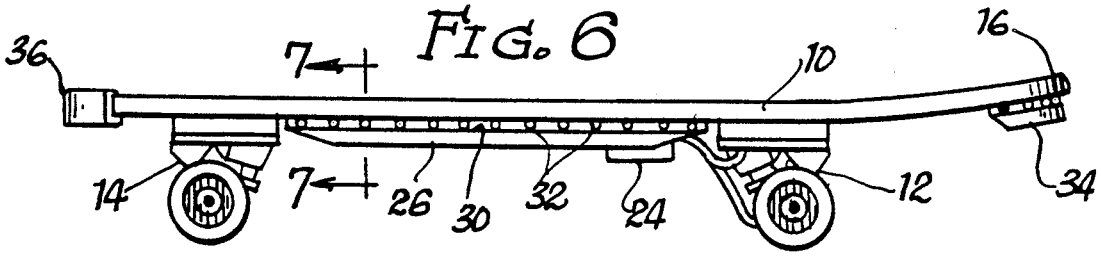
FIG. 6 is a side elevational view of FIG. 5.
Figure 7:
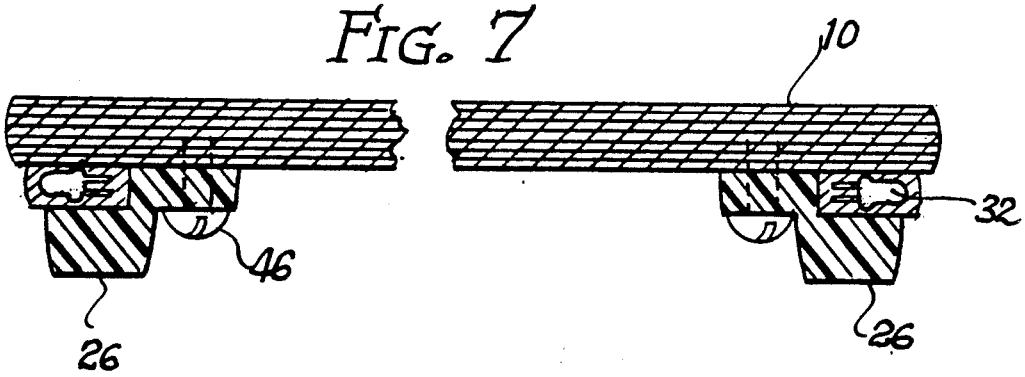
FIG. 7 is a section taken along line 7—7 of FIG. 6.
Figure 8:
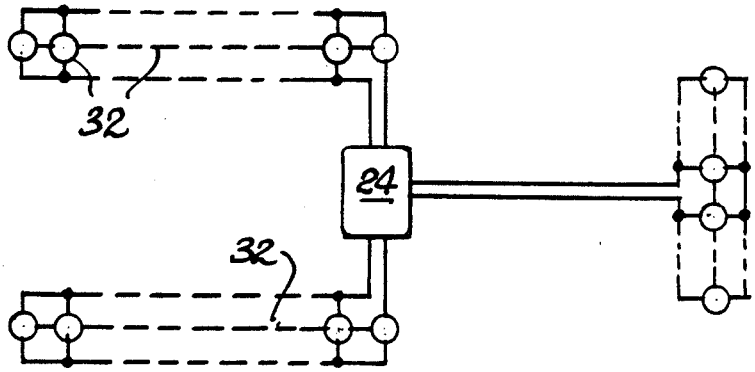
FIG. 8 is a schematic of the circuitry of the second embodiment.

The mounting of the side boards is shown in FIG. 7, wherein screws 46 pass through screw holes in the side board and penetrate directly into the board portion 10 of the skateboard. A wiring arrangement, physically shown in FIG. 5, is shown diagrammatically and schematically in FIG. 8. The microcontroller, indicated at 24 in FIG. 8, wires left and right sides, and the front, of the device independently.

Thus, the bank of LED's on the left must all go off and on together, as must the bank on the right and the rear. A preferred technique is to have the right and left banks flash alternately, with the front panel moving independently.

In both embodiments, the invention represents not only a safety feature, but a sales "gimmick" as well, and an aesthetic enhancement of skateboards.

I claim:

1. An improvement to a skateboard comprising:

(*a*) a battery-powered microcontroller mounted to the bottom side of said skateboard;

(*b*) at least one string of LED's wired to and driven by said microcontroller;

(*c*) mounting means mounting said at least one string of LED's to the periphery of said skateboard; and, (*d*) said skateboard defining a peripheral groove and said at least one string of LED's being mounted in said groove.

2. An improvement to a skateboard according to claim 1 wherein said mounting means comprises glue injected hot into said groove.

3. An improvement to a skateboard according to claim 1 wherein said mounting means comprises resin poured into said groove over said string of LED's.

4. An improvement to a skateboard according to claim 1 wherein said microcontroller is mounted just centerward of one of the trucks of said roller and is covered by a plate.

* * * * *